US008796530B2

(12) United States Patent
Kemper

(10) Patent No.: US 8,796,530 B2
(45) Date of Patent: Aug. 5, 2014

(54) MUSICAL INSTRUMENT WITH ACOUSTIC TRANSDUCER

(76) Inventor: Christoph Kemper, Bochum (DE)

( * ) Notice: Subject to any disclaimer, the term of this patent is extended or adjusted under 35 U.S.C. 154(b) by 0 days.

(21) Appl. No.: 11/881,818

(22) Filed: Jul. 27, 2007

(65) Prior Publication Data

US 2008/0134867 A1 Jun. 12, 2008

(30) Foreign Application Priority Data

Jul. 29, 2006 (DE) ..... 10 2006 035 188

(51) Int. Cl.
*G10H 3/00* (2006.01)

(52) U.S. Cl.
USPC ..... 84/723; 84/616; 84/622; 84/726; 84/735

(58) Field of Classification Search
CPC ..... G10H 3/00
USPC ..... 84/616, 622, 723, 726, 735
See application file for complete search history.

(56) References Cited

U.S. PATENT DOCUMENTS

| | | | | |
|---|---|---|---|---|
| 4,069,732 | A * | 1/1978 | Moskowitz et al. | 84/727 |
| 5,133,014 | A | 7/1992 | Pritchard | |
| 5,173,567 | A | 12/1992 | Fujita | |
| 5,286,916 | A * | 2/1994 | Yamauchi | 84/661 |
| 5,461,189 | A * | 10/1995 | Higashi et al. | 84/601 |
| 5,541,354 | A * | 7/1996 | Farrett et al. | 84/603 |
| 5,581,621 | A | 12/1996 | Koyama et al. | |
| 5,587,548 | A | 12/1996 | Smith, III | |
| 5,841,875 | A * | 11/1998 | Kuroki et al. | 381/61 |
| 6,320,113 | B1 | 11/2001 | Griffin et al. | |
| 6,392,135 | B1 | 5/2002 | Kitayama | |
| 6,448,488 | B1 | 9/2002 | Ekhaus et al. | |
| 6,504,935 | B1 | 1/2003 | Jackson | |
| 6,740,805 | B2 | 5/2004 | Metcalf | |
| 7,285,710 | B1 * | 10/2007 | Wallace | 84/454 |
| 2001/0045153 | A1 * | 11/2001 | Alexander et al. | 84/609 |
| 2003/0161493 | A1 * | 8/2003 | Hosler | 381/353 |
| 2004/0187673 | A1 | 9/2004 | Stevenson | |
| 2004/0200337 | A1 * | 10/2004 | Abe et al. | 84/616 |
| 2005/0045027 | A1 | 3/2005 | Celi et al. | |
| 2005/0115383 | A1 * | 6/2005 | Chang | 84/616 |
| 2005/0120859 | A1 * | 6/2005 | England | 84/290 |
| 2005/0145103 | A1 | 7/2005 | Haga | |
| 2005/0257671 | A1 * | 11/2005 | Aimi | 84/735 |
| 2006/0011046 | A1 * | 1/2006 | Miyaki et al. | 84/616 |
| 2006/0016324 | A1 * | 1/2006 | Hsieh | 84/622 |
| 2006/0065106 | A1 * | 3/2006 | Pinxteren et al. | 84/615 |
| 2006/0147050 | A1 | 7/2006 | Geisler | |
| 2007/0056435 | A1 * | 3/2007 | Juszkiewicz et al. | 84/726 |
| 2007/0079694 | A1 * | 4/2007 | Pakzad | 84/723 |

FOREIGN PATENT DOCUMENTS

| | | |
|---|---|---|
| DE | 202004008347 | 10/2004 |
| DE | 103 92 940 | 7/2005 |
| EP | 0725381 B1 | 6/2001 |

* cited by examiner

*Primary Examiner* — Kawing Chan
(74) *Attorney, Agent, or Firm* — Patent Central LLC; Stephan A. Pendorf

(57) ABSTRACT

The musical instrument has a acoustic transducer, which transforms an excitation signal generated by at least one resonator into an acoustic signal. The acoustic transducer is provided with an adjustable oscillation profile, in which at least one profile parameter is defined by a reference profile of a reference instrument.

22 Claims, 6 Drawing Sheets

MUSICAL INSTRUMENT WITH ACOUSTIC TRANSDUCER

BACKGROUND OF THE INVENTION

1. Field of the Invention

The invention pertains to a musical instrument with an acoustic transducer, which transforms an excitation signal generated by at least one resonator into an acoustic signal, and in which the acoustic transducer is provided with an adjustable oscillation profile, in which at least one profile parameter is defined by a reference profile of a reference instrument.

2. Description of the Related Art

The production of sound by a musical instrument usually occurs through the interaction of three individual components. First, an excitation occurs, by means of which an excitation energy is introduced into the instrument. This can be the bow of a violin, for example, or the hammer of a piano or the mouthpiece and reed of a saxophone. Another component involves the presence of one or more resonators, which determine the fundamental frequency of the individual tones. The resonators can have constant or variable properties.

Resonators are, for example, the strings of a violin or guitar or the variable air column of a saxophone. Together, the excitation energy introduced into the resonator, the exciting element, and the resonator lead to the production of sound.

The third component participating in the production of sound is a sound transducer or resonance body, which transforms the oscillatory energy provided by the instrument into sound levels of the surrounding air and as a result transports the oscillatory energy into the air with the greatest possible efficiency. These resonance bodies are, for example, the body of a violin, the bell of a saxophone, the pickup of an electric guitar, or the loudspeaker of a guitar amplifier.

The sound transducer or resonance body is usually an acoustic or electroacoustic impedance transducer and is typically designed so that the instrument will produce a high perceptible volume. In addition, the sound transducer or resonance body has the task of forming the frequency spectrum of the instrument, so that, in this way, the instrument will produce a beautiful and characteristic sound.

The character of the sound influenced by the resonance body is the essential factor in determining the perceived quality of a musical instrument and thus also the quality of a musical performance. The acoustic properties of the sound transducer are determined both by its geometry and by the selected materials.

From an acoustic standpoint, the individual sound character of an instrument is determined by the so-called "formants". These formants are narrow-band peaks in the frequency spectrum and are usually independent of the pitch being played. The human ear reacts with great sensitivity to these formants by a process of pattern recognition, so that even musically untrained people are easily able to differentiate the sound of a violin from the sound of a viola, even though the instruments differ essentially only through the size of their sound bodies.

Because of the large number of physical parameters which determine the sound impression of a certain sound transducer or of the resonance body, it usually turns out also to be an extremely complicated matter to provide a resonance body with a precisely predetermined sound profile. Another essential problem is encountered when a relatively large number of resonance bodies are to be produced with essentially the same predetermined sound impressions.

It is known from DE 103 92 940 T5 that an acoustic signal generated by a sound transducer of a musical instrument can be modified. The sound transducer is provided with an adjustable oscillation profile. The oscillation signal is modified by the use of a signal processor.

US 2005/0045027 A1 describes a variable memory for frequency responses to be determined in order to adapt the sound of a musical instrument to other specified instruments. Corresponding stored frequency responses are called up and processed within the framework of a control process.

U.S. Pat. No. 6,740,805 B2 describes a process for radiating a previously recorded and stored spatial sound event. The sound event is recorded in a first step by the use of several microphones distributed in space, and then the recording is played back without the participation of any other musical instrument.

DE 20 2004 008 347 U1 describes a method for the algorithmic production of melodies under consideration of external factors.

In U.S. Pat. No. 5,578,548 A, a processing method is described for combining a frequency response of a sound body of a musical instrument with the frequency response of an excitation of the resonator. As a result of this combination, the required processor power and the memory capacity can be reduced.

U.S. Pat. No. 6,392,135 B1 describes a virtual musical instrument which can play back stored sound material in an adaptable manner.

SUMMARY OF THE INVENTION

The task of the present invention is to design a musical instrument of the type described above in such a way that the production of a predefined sound impression is supported.

This task is accomplished according to the invention in that the reference profile is generated by the use of technical measuring means to record the sound of the reference instrument, and in that the acoustic transducer, as part of a closed-loop control circuit, is designed to evaluate the difference between the reference profile and the characteristic profile of the acoustic transducer.

By designing the acoustic transducer with an adjustable oscillation profile and by parameterizing this oscillation profile as a function of the reference profile of a reference instrument, it is possible to copy the reference profile of any selected reference instrument. It is thus possible to bring the sound impression of the acoustic transducer very close to the sound impression of the reference instrument. In particular, it is also possible to produce a large number of acoustic transducers with the same sound impression as that determined by the reference profile of the reference instrument. In particular, it is intended that the acoustic transducer function as a sound transducer to generate an acoustic sound signal.

The acoustic transducer is typically realized in that the acoustic transducer is designed as a resonance body.

An embodiment consists in that the sound transducer is designed as an acoustic resonance body.

In addition, the invention also proposes that the acoustic transducer be designed as an electroacoustic resonance body.

To provide a characteristic reference profile, it is proposed that the reference profile be determined by mean-value formation during a predetermined time interval.

A useful acoustic impression can be stored by defining the reference profile as the frequency response of the reference instrument.

In particular, an exact definition of the acoustic impression is supported in that the reference profile defines a statistical distribution of pitches and volumes.

A reference profile can be acquired directly if the reference profile is defined by evaluating music played at the time of evaluation.

There is no need for the reference instrument to be physically present if the reference profile is defined by evaluation of recorded music.

An adaptive frequency response adjustment of the acoustic transducer is supported by connecting a measuring device for measuring the frequency response of the acoustic transducer to the acoustic transducer.

A concrete realization of the parameterization is accomplished in that the acoustic transducer has at least one adaptive element for frequency response adjustment.

An exact adaptation of the characteristic profile to the reference profile can be accomplished by designing the acoustic transducer as part of a closed-loop control circuit for evaluating the difference between the reference profile and a characteristic profile of the acoustic transducer.

The ability to influence individual elements is achieved in that the parameterization of the acoustic transducer can be adjusted manually.

BRIEF DESCRIPTION OF THE DRAWINGS

Exemplary embodiments of the invention are illustrated in the drawings.

DETAILED DESCRIPTION OF THE PREFERRED EMBODIMENTS

Figure 1:
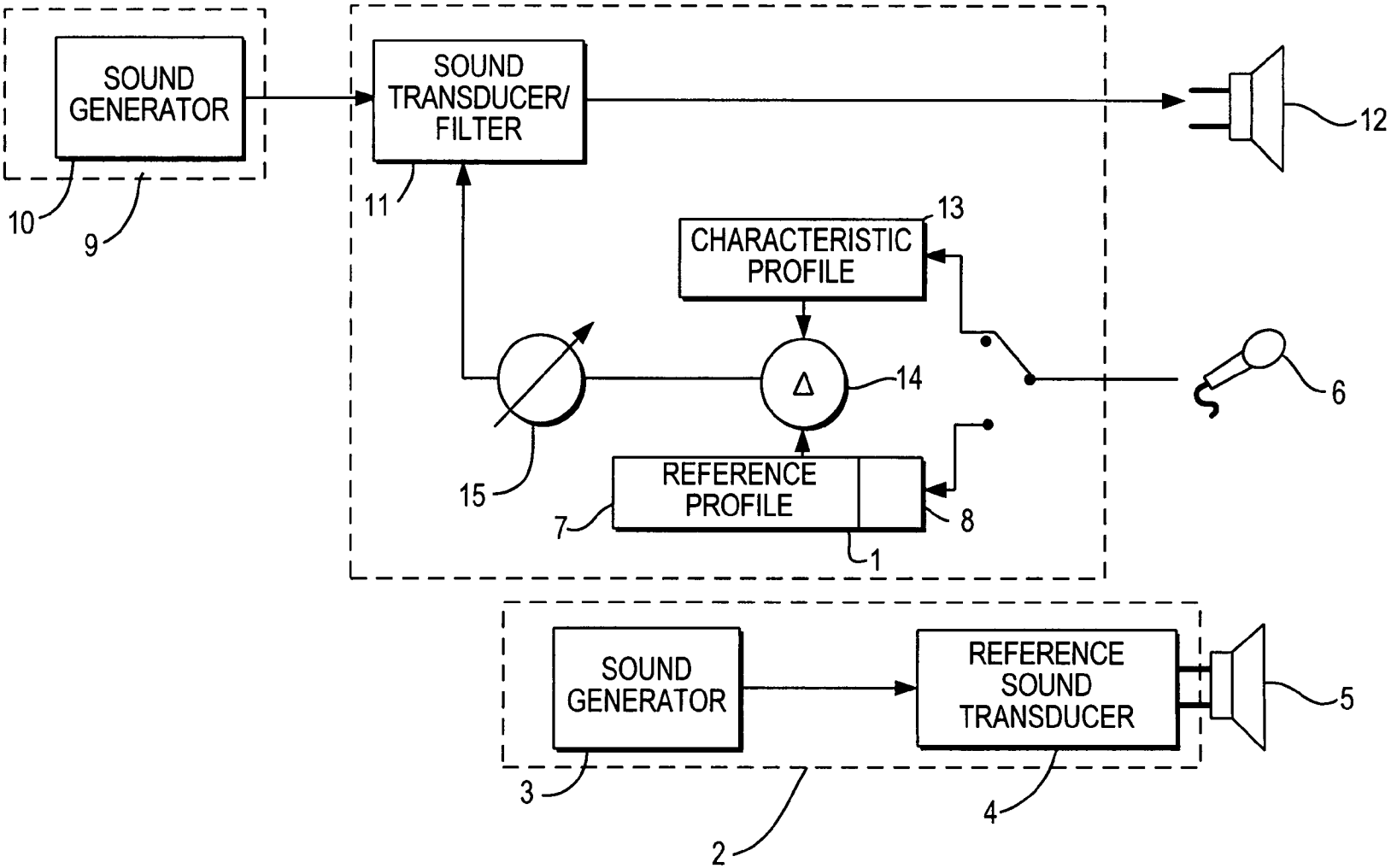
FIG. 1 shows a schematic diagram of the generation, acquisition, and use of a reference profile for the parameterization of an acoustic transducer.

FIG. 1 is a schematic functional block diagram showing the generation, storage, and use of a reference profile 1. A reference sound is generated directly or with the use of a loudspeaker 5 by a reference instrument 2, which is made up of a sound generator 3 and a reference sound transducer 4. This sound is picked up by a microphone 6. The microphone 6 is connected to a reference memory 7, which makes it possible to store the reference profile. The reference memory 7 is connected to a signal processor 8, which supports in particular a statistical evaluation of the sound impression picked up by the microphone.

The reference profile 1 can be acquired, for example, by recording a sufficiently long musical performance on a specific reference instrument 2 and by using the signal processor 8 to evaluate it with respect to the characteristic frequency response of the reference instrument 2 or its reference sound transducer 4. The signal processor 8 can include a mean-value formation function.

The signal processor 8 not only determines a frequency response of the reference sound transducer 4 but also analyzes and records the frequency response of the sound production. The result of the statistical evaluation is thus also dependent on the type of musical performance and especially on the statistical distribution of the pitches played and their volume. A typical reference profile thus contains the associated amplitude values or relative amplitude components based on the total signal amplitude for individual frequency components. The frequency response is quantified with sufficiently high resolution.

Because the microphone 6 is connected to the reference memory 7 or to the signal processor 8, it is not necessary for the reference instrument to be physically present during the signal processing. An audio recording of the sound impression of the reference instrument 2 has proven be to sufficient. According to an embodiment of the invention, it is also specifically intended that several different reference profiles 1 be filed in the area of the reference memory 7. A user can thus choose between several reference profiles 1.

According to the embodiment in FIG. 1, the inventive musical instrument 9 has a sound generator 10, which is connected to a sound transducer 11. The sound transducer 11 generates an acoustic signal, which is sent directly or by the use of a loudspeaker 12 to an environment. The current characteristic profile 13 of the sound transducer 11 is sent to a difference former 14, which evaluates the reference profile 1 as a second input variable. The output signal produced by the difference former is sent under consideration of an amplification 15 to the sound transducer 11 and parameterizes its concrete sound impression present here.

If the difference former 14 yields the value zero as its output signal, the sound transducer 11 has varied its sound impression in such a way that the its current characteristic profile is the same as the predetermined reference profile 1. The sound transducer 11 is typically designed in such a way that it has a variable and parameterizable sound impression and continuously measures the frequency response of an output signal during the musical performance itself. The sound transducer 11 thus automatically determines its own characteristic profile 13 simultaneously with the generation of the musical performance.

By means of a permanent or cyclical comparison of its own characteristic profile 13 with the reference profile 1, the variable sound transducer 11 is changed in such a way that the differences between the characteristic profile 13 and the reference profile 1 are minimized. The musical instrument 9 thus takes on adaptively the sound impression of the reference instrument 2 through the parameterization of its sound transducer 11.

The adaptation of the frequency response of the musical instrument 9 can take place either automatically or interactively with a user. It is possible in particular to influence the adaptation process manually in such a way that the user can interactively control the frequency response adaptation through the manner of his musical performance. In particular, the musician can, through the statistical choice of pitches and volumes, control the approach to the reference profile 1.

It is also possible for the musician, with an artistic purpose in mind, to lead the behavior of the sound transducer 11 away from the reference profile 1 by intentionally playing the musical instrument to be parameterized differently in order to generate an individual sound impression.

The explanations of the design of the sound transducer 11 and the associated functional components in combination with the musical instrument provided above also apply in the same way to a realization in hardware without orientation around a musical instrument and even without the simultaneous generation of an acoustic sound signal. According to the embodiment in FIG. 1, the closed-loop control circuit provided by the feedback includes the path through the air between the loudspeaker 12 and the microphone 6.

Figure 2:
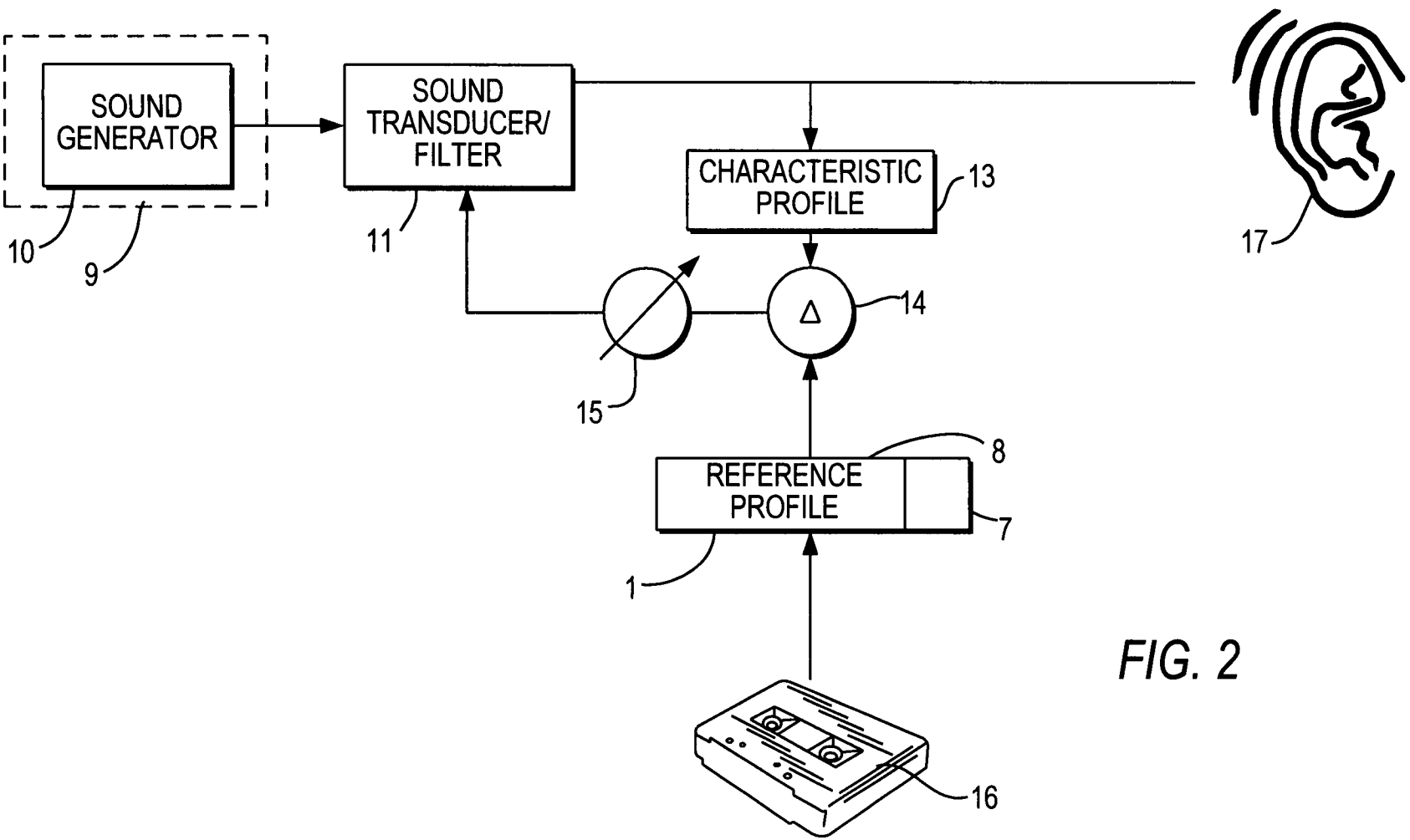
FIG. 2 shows a schematic diagram illustrating a change to the characteristic profile of an acoustic transducer under consideration of a reference profile.

FIG. 2 illustrates a sequence of events by which the reference profile 1 is generated by the use of an audio recording, which is stored on, for example, an audio cassette 16. The sequence of steps of the process is essentially the same as that described on the basis of FIG. 1, but in addition the ear 17 of a user or a listener is also shown. Reference profiles 1 stored in some other way can also be used.

As an alternative to the direct generation of an acoustic sound signal by the sound transducer 11, it is also possible for the sound transducer 11 to generate an electrical or some other type of output signal, which is converted, either simultaneously or after a delay, to an acoustic sound signal in a further processing step. For example, the immediate output signal of the sound transducer 11, generally referred to below as the "acoustic transducer", can be recorded first, and after it has been stored appropriately transformed at a later time into audible sound.

The acoustic transducer 11 can also be realized as a digital or analog circuit, the output signal of which is sent to an amplifier or directly to a speaker or to some other type of sound generator. In the case of a digital realization of the acoustic transducer 11, it is specifically intended that the signal processing be conducted by the use of Fourier transformation.

In another embodiment, the acoustic transducer 11 can be realized as an adaptive filter. According to the embodiment in FIG. 2, it is not necessary for the acoustic path through the air to be included as a transmission path in the closed-loop control circuit provided.

Figure 3:
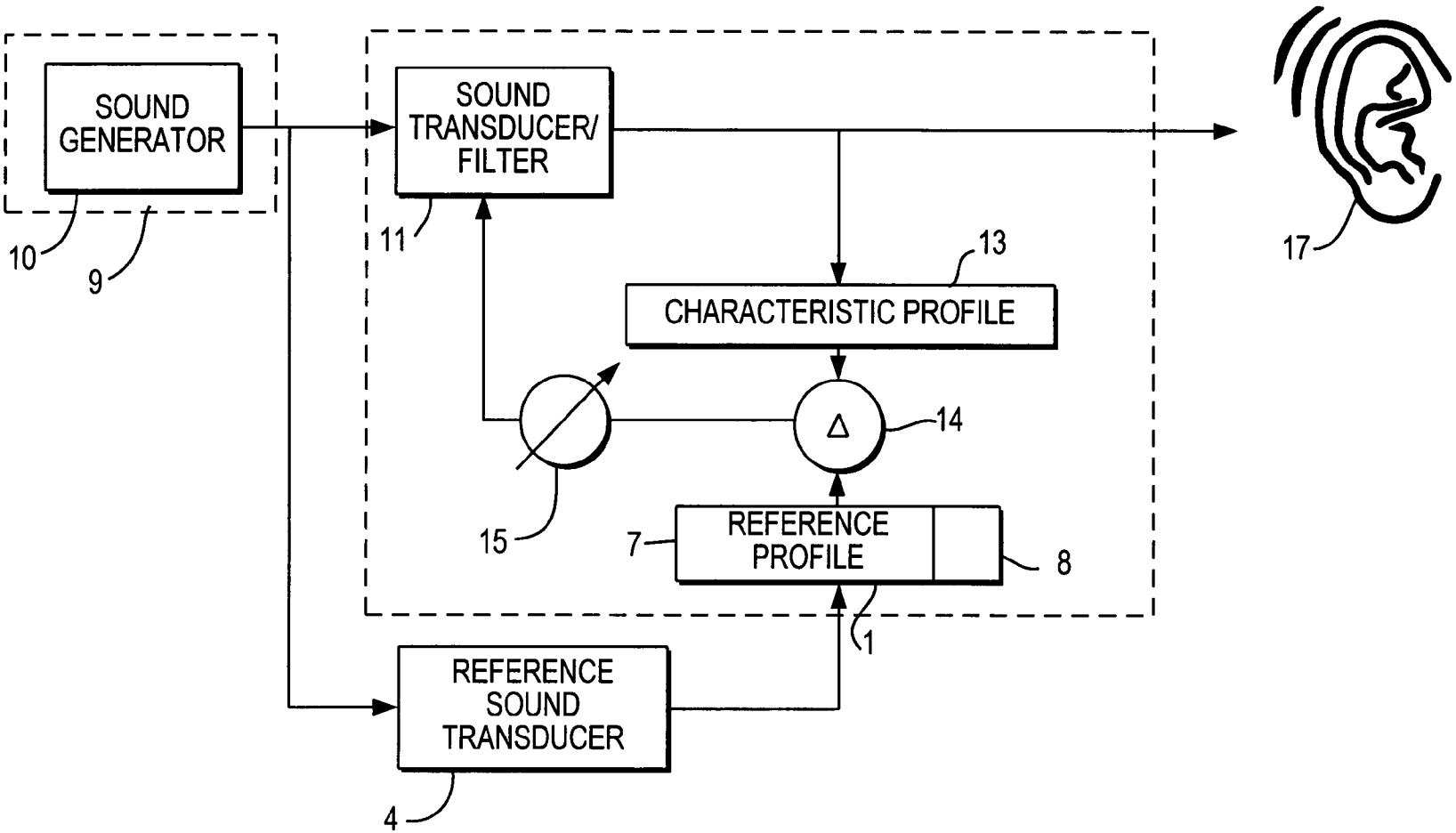
FIG. 3 shows a schematic diagram illustrating a design variant, in which the transmission characteristic of an acoustic transducer is adapted to the transmission characteristic of a reference acoustic transducer.
Figure 4:
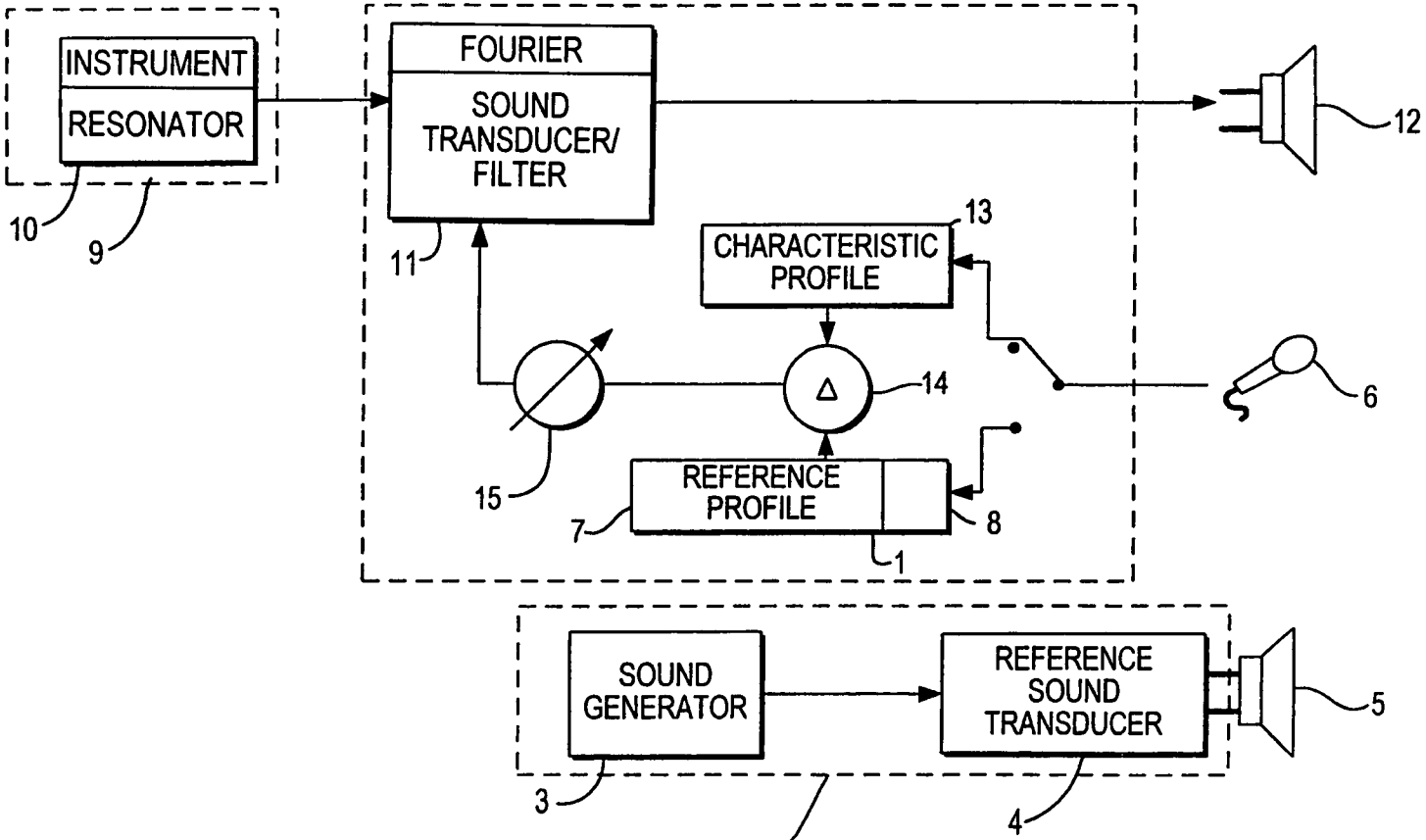
FIGS. 4-6 show additional features of the invention.
Figure 5:
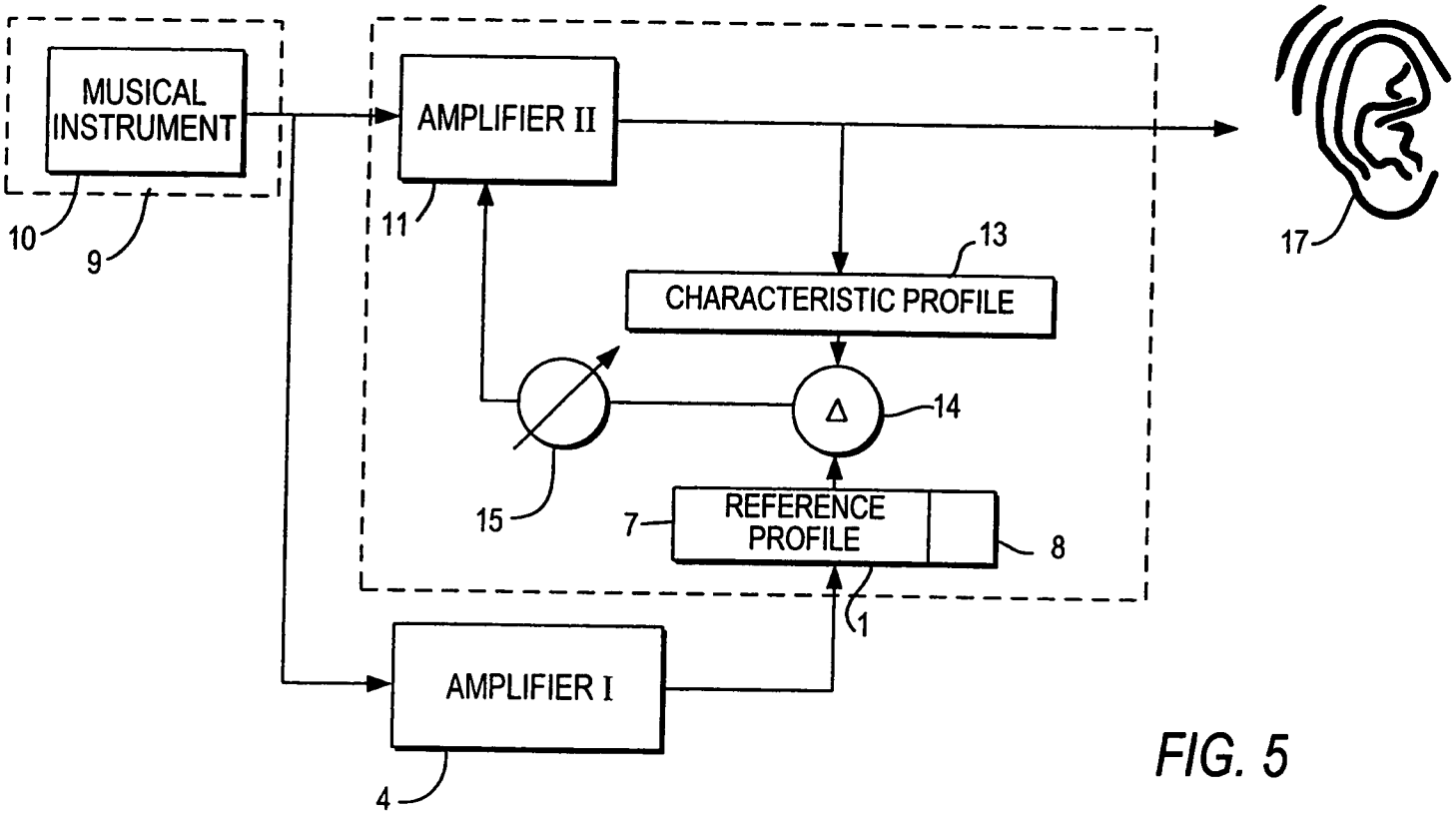
Figure 6:
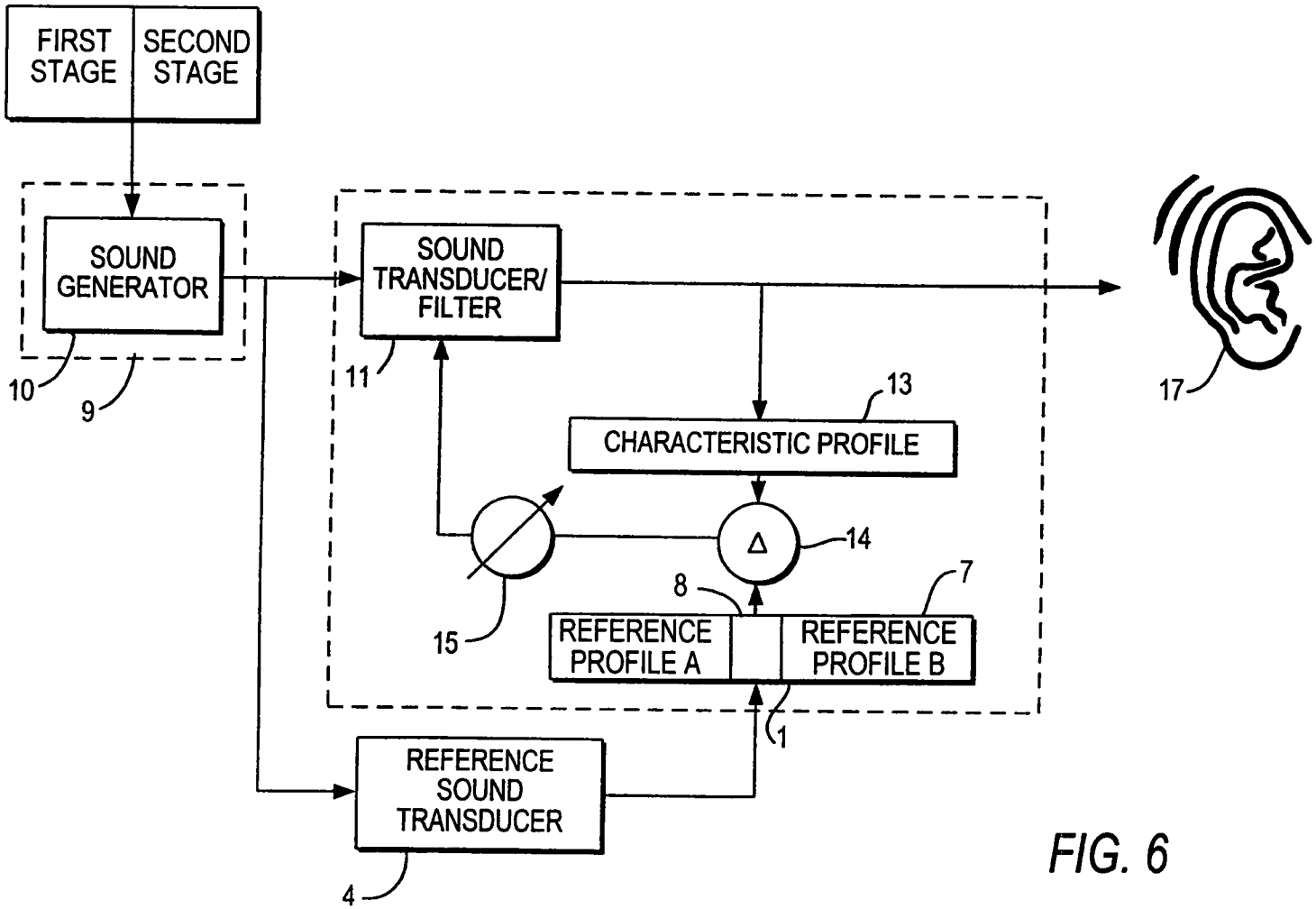

FIG. 3 shows an embodiment in which the sound generator 10 of the musical instrument 9 sends its output signal both to the sound transducer 11 and to the reference sound transducer 4. The output signal of the sound transducer 11 is fed back via its own characteristic profile 13, the difference former 14, and an adjustable amplifier 15. Also sent to the difference former 14 is the output signal of the reference sound transducer 4 by way of the reference memory 7 and the signal processor 8. The transmission profile of the sound transducer 11 can thus be adapted to the transmission profile of the reference sound transducer 4. In particular it is also possible in this way to adapt the transmission behavior of a sound transducer 11 consisting of comparatively inexpensive hardware to the transmission behavior of a high-quality reference sound transducer 4.

According to the embodiment in FIG. 3, the transmission behavior of the sound transducer 11 can be adapted during the simultaneous transmission of the output signal of the sound generator 10 both to the reference sound transducer 4 and to the sound transducer 11, but it is also possible to incorporate a delay, i.e., to store the reference profile 1 first, using the reference sound transducer 4, and to adapt any desired number of sound transducers 11 to the reference profile 1 over the course of subsequent process steps. The process is therefore also suitable for conducting series production. Such series production can take the form of an adaptation performed individually for each device, or a single adaptation profile can be stored and then used identically for each device to be adapted.

The acoustic transducer 11 explained above was preferably a sound transducer. The actual generation of the sound and/or the processing of an input signal present originally as a sound signal, however, does not represent an indispensable part of the invention. Instead, the sound transducer explained above is only one embodiment of the acoustic transducer. The acoustic transducer can also be designed as a loudspeaker, as a linear or nonlinear amplifier, as a guitar amplifier, as a processor, or as an audio effects processor. The realization can proceed in either analog or digital fashion as desired or in partially analog and partially digital fashion. Signal processors can also be used as acoustic transducers.

The evaluated reference sound profile can be determined by acoustic means using the previously explained reference sound transducer 4, but purely electronic processing is also conceivable. When the sound profile of an actual instrument is evaluated, it is possible to evaluate the previously mentioned musical performance on this instrument, but it is also possible to subject the instrument mechanically or electrically to an excitation function and to analyze the corresponding output signal. It is not necessary in this case to generate sounds which are musical in the strict sense; on the contrary, the sounds can be produced as a function of test signals or test excitations.

The inventive acoustic transducer and the reference acoustic transducer are not necessarily an inseparable part of the musical instrument and can be excited both by a musical instrument and also by some other type of analytical, wideband signal for the performance of the inventive measurements.

Alternatively or in addition, it is also possible to use acoustic transducers or sound transducers or resonance bodies which have a nonlinear transmission function. The difference versus linear acoustic transducers is that the spectrum generated by a nonlinear acoustic transducer is dependent on the amplitude of the input signal. In addition, a polyphonic musical instrument generates intermodulations or distortions in the nonlinear acoustic transducer.

These nonlinearities are often desired and are considered part of the characteristic sound of the sound transducer. An example is a guitar amplifier or a loudspeaker or the combination of the two. The amplifier is often operated in the nonlinear range in which the sound transducer (the loudspeaker) generates distortions in the amplifier stage because of its high energy uptake. The loudspeaker itself also generates a high distortion factor, because, when large signal deflections occur, the damping suspension of the diaphragm moves outside its linear range.

Other sound processors, some of which are historic, such as analog equalizers, can be used here. They generate nonlinearities which, together with the frequency response changes, have a positive effect on the sound.

Typical nonlinearities impose upper and lower limits on the signal amplitude. This occurs more-or-less "gently", depending on the characteristic curve. Small amplitudes, however, remain almost completely linear and uncompressed.

It has been found that a nonlinear acoustic transducer can be broken down into three components: the pure nonlinearity, the frequency response before this nonlinearity, and the frequency response after it.

At high signal levels, the input-side frequency response determines primarily the character of the distortion and of the intermodulations. The output-side frequency response, however, generates the characteristic formants of the acoustic transducer. At low signal levels, the nonlinearity has no significance and can be ignored. In this case the two frequency responses are perceived as a single frequency response.

Building on the device of the adaptive acoustic transducer, we wish in the following to explain a device which picks up both frequency responses of a nonlinear reference acoustic transducer and applies them to an adaptive nonlinear acoustic transducer.

The inventive acoustic transducer has in particular two separate oscillation profiles with nonlinearity between them.

Two reference profiles are now determined by the reference acoustic transducer:

A reference profile A at a low input level. Here the nonlinearity of the reference is unimportant with respect to the frequency response. This first profile represents the multiplication of the two frequency responses. The overall level is determined by the amplification of the nonlinearity around its zero point.

A second reference profile B at a high input level. Here the nonlinearity separates the two frequency responses from each other. The intermodulations and overtones which now arise are determined exclusively by the frequency response in front. The frequency spectrum resulting from the nonlinearity is formed by the frequency response coming after. The overall level is determined by the absolute amplitude limitation of the nonlinearity.

The adaptive nonlinear acoustic transducer is preferably adapted to the reference acoustic transducer in two stages:

In the first stage, the adaptive acoustic transducer is assumed to be linear with a frequency response L. At a low input level, this frequency response L is controlled in such a way that that its own characteristic profile corresponds to the reference profile A. This process corresponds exactly to the previously described closed-loop control circuit. The determined frequency response L, however, is only an interim result: It corresponds to the multiplication of the two frequencies in front of and behind the nonlinearity. The individual course of the frequency responses, however, is still unknown.

In the second stage, the adaptive acoustic transducer is set up as the previously described combination of two frequency responses A and B, between which there is a nonlinearity. In the case of a high signal level, the frequency response B is controlled in such a way that its own characteristic profile corresponds to the reference profile B. This process corresponds exactly to the previously described closed-loop control circuit.

The characteristic profile, however, is now also influenced by frequency response A and the nonlinearity. Here the closed-loop control circuit receives its second feedback: While frequency response B is being controlled, frequency response A is modified simultaneously in such a way that the multiplication of frequency response A by frequency response B corresponds to the previously described frequency response L.

Therefore, frequency response A is regulated inversely: If the level of a spectral component of frequency response B is raised, the level of the corresponding spectral component of frequency response A is lowered to the same extent. Thus the combined serial frequency response L remains preserved.

Frequency response A, in spite of the following nonlinearity, also has an influence on the characteristic profile of the acoustic transducer and thus on the automatic control process. Through the compressing effect of the nonlinearity, however, this influence is smaller than that of frequency response B. This guarantees that the automatic control process does not become unstable or indifferent at any point.

If, as a result of the automatic control process in the second, the difference between reference profile B and the characteristic profile has been minimized, then frequency responses A and B have been matched to each other exactly.

Not only frequency responses A and B but also the character of the intermediate nonlinearity also has a decisive effect on the dynamic sound behavior of the acoustic transducer.

The present invention is based essentially on a trivial nonlinearity like that which occurs everywhere in nature.

The conditions of the trivial nonlinearity are:

a quasilinear behavior at low amplitude;

absolute upper and lower limits on the amplitude;

a monotonic characteristic curve;

no hysteresis; and no memory: the nonlinearity always delivers the same output value for the same input value, regardless of the previous course of the signal.

The trivial nonlinearity has two fundamental parameters: the amplification in the quasilinear range and the level of the absolute amplitude limitation.

These two parameters can be freely selected in the inventive nonlinear acoustic transducer. They are acquired by the previously described two-stage determination of the characteristic profile in frequency responses L or A and B and compensated via the automatic control process, because all of the frequency responses and profiles naturally also contain absolute level amplifications or attenuations.

The combined frequency response L thus corrects the amplification in the quasilinear range. Frequency response B coming after corrects the level of the absolute amplitude limitation of the nonlinearity.

The invention claimed is:

1. A musical instrument with an acoustic transducer, which transforms an excitation signal generated by at least one resonator of the musical instrument into an acoustic signal, and in which the acoustic transducer is provided with an adjustable oscillation profile, in which at least one target profile parameter is defined by a reference profile of a reference instrument, wherein the reference profile (1) is generated by the use of technical measuring means to record the sound of the reference instrument (2), and where the acoustic transducer (11), as part of a closed-loop control circuit, is connected to a difference former that evaluates the difference between the reference profile (1) and the acoustic transducer's (11) own characteristic profile (13), wherein the reference profile (1) is stored in a reference memory (7) which is coupled to a signal processor (8), wherein both the reference profile (1) and the characteristic profile (13) are each processed by the signal processor (8) as frequency response, wherein, after processing of the frequency responses of the reference profile and the characteristic profile, based on a difference between the frequency responses, the frequency response of the characteristic profile of the acoustic transducer is changed in the closed-loop control circuit in such a way that the difference between the frequency responses of the reference profile and the frequency response of the characteristic profile is minimized.

2. A musical instrument according to claim 1, wherein the acoustic transducer (11) is a resonance body.

3. A musical instrument according to claim 1, wherein the acoustic transducer (11) is an acoustic resonance body.

4. A musical instrument according to claim 1, wherein the acoustic transducer (11) is an electroacoustic resonance body.

5. A musical instrument according to claim 1, wherein the reference profile (1) is determined by mean-value formation during a predetermined time interval.

6. A musical instrument according to claim 1, wherein the reference profile (1) is defined by the frequency response of the reference instrument (2).

7. A musical instrument according to claim 1, wherein the reference profile (1) defines a statistical distribution of pitches and volumes.

8. A musical instrument according to claim 1, wherein the reference profile is defined by evaluation of music played at the time of evaluation.

9. A musical instrument according to claim 1, wherein the reference profile (1) is defined by evaluation of recorded music.

10. A musical instrument according to claim 1, wherein a measuring device for measuring a frequency response of the acoustic transducer (11) is connected to the acoustic transducer (11).

11. A musical instrument according to claim 1, wherein the acoustic transducer (11) includes the at least one adjustable oscillation profile for adjusting its frequency response.

12. A musical instrument according to claim 1, wherein the parameterization of the acoustic transducer (11) is influenced manually.

13. An acoustic transducer, which transforms an excitation signal generated by at least one resonator into an acoustic signal, wherein the acoustic transducer (11) is provided with an adjustable oscillation profile, where at least one profile parameter is defined by a reference profile (1) of a reference instrument (2) where the reference profile (1) is generated by the use of technical measuring means to record the sound of the reference instrument (2), and where the acoustic transducer (11), as part of a closed-loop control circuit, is connected to a difference former that evaluates the difference between the reference profile (1) and the acoustic transducer's (11) own characteristic profile (13), wherein the reference profile (1) is stored in a reference memory (7) which is coupled to a signal generator (8), wherein both the reference profile (1) and the characteristic profile (13) are each processed by the signal processor (8) as frequency response, wherein, after processing of the frequency responses of the reference profile and the characteristic profile, based on a difference between the frequency responses, the frequency response of the characteristic profile of the acoustic transducer is changed by the closed-loop control circuit in such a way that the difference between the frequency response of the reference profile and the frequency response of the characteristic profile is minimized, wherein the acoustic transducer (11) is adapted to a reference acoustic transducer in two stages, wherein the acoustic transducer (11) is adapted in a first stage with a linearized transmission function to a reference profile A and in a second stage under consideration of two frequency responses A and B with an intermediate nonlinearity to a reference profile B, and wherein the acoustic transducer (11) is designed as part of a musical instrument.

14. An acoustic transducer according to claim 13, wherein the acoustic transducer (11) is designed at least in part as a digital circuit.

15. An acoustic transducer according to one claim 13, wherein the acoustic transducer (11) has a device for conducting a Fourier transformation.

16. An acoustic transducer according to claim 13, wherein the acoustic transducer (11) is designed as part of a digital guitar amplifier.

17. An acoustic transducer according to claim 13, wherein the musical instrument is designed as at least the sound generator (3), the sound transducer (4), and an amplifier.

18. An acoustic transducer according to claim 13, wherein the acoustic transducer (11) is designed as an adaptive filter.

19. An acoustic transducer according to claim 13, wherein a design for the simultaneous acquisition of both the reference profile (1) and a characteristic profile is provided.

20. An acoustic transducer according to claim 13, wherein the transmission characteristic of the acoustic transducer is at least partially nonlinear.

21. An acoustic transducer according to claim 13, wherein the resonance body of the musical instrument has a nonlinear transmission function.

22. An acoustic transducer according to claim 13, wherein the acoustic transducer (11) has separate oscillation profiles with an intermediate nonlinearity.

* * * * *